US005285544A

United States Patent [19]

Weber

[11] Patent Number: 5,285,544

[45] Date of Patent: Feb. 15, 1994

[54] METHOD OF TREATING A WEB OF MATERIAL WITH A LIQUID

[75] Inventor: Hans Weber, Uzwil, Switzerland

[73] Assignee: Benninger AG, Uzwil, Switzerland

[21] Appl. No.: 946,108

[22] Filed: Sep. 17, 1992

[30] Foreign Application Priority Data

Sep. 23, 1991 [CH] Switzerland ..... 2814/91

[51] Int. Cl.[5] ..... D06B 3/12

[52] U.S. Cl. ..... 8/151; 8/158; 68/15; 68/184; 68/207

[58] Field of Search ..... 8/151, 158; 68/15, 175, 68/181 R, 184, 207; 134/122 R, 122 P

[56] References Cited

U.S. PATENT DOCUMENTS 3,042,480 7/1962 Chipalkatti et al. ..... 8/151
3,152,464 10/1964 Faraguna ..... 68/184
3,241,343 3/1966 Yazawa ..... 68/181 X
3,315,501 4/1967 Muller ..... 68/181 R
3,346,893 10/1967 Carpenter ..... 68/181 X
3,916,651 11/1975 Carruthers ..... 68/181 X
4,038,842 8/1977 Mizutani ..... 68/177

FOREIGN PATENT DOCUMENTS 2037438 2/1970 France .

*Primary Examiner*—Philip R. Coe
*Attorney, Agent, or Firm*—Shoemaker and Mattare Ltd.

[57] ABSTRACT

The treatment of a material web (2) ensues in a U-shaped shaft comprising two shaft limbs (3, 4) and a connecting area (5) between both the shaft limbs. The shaft is filled with a treatment liquid, the feed of fresh treatment liquid and also the circulation of treatment liquid ensuing beneath the surface of the liquor within the shaft limb. The effect is a particularly intensive charging of the material web, with extremely economic use of treatment liquid. Foaming of the treatment liquid is prevented, also in the case of heavy turbulence.

7 Claims, 4 Drawing Sheets

METHOD OF TREATING A WEB OF MATERIAL WITH A LIQUID

Figure 1:
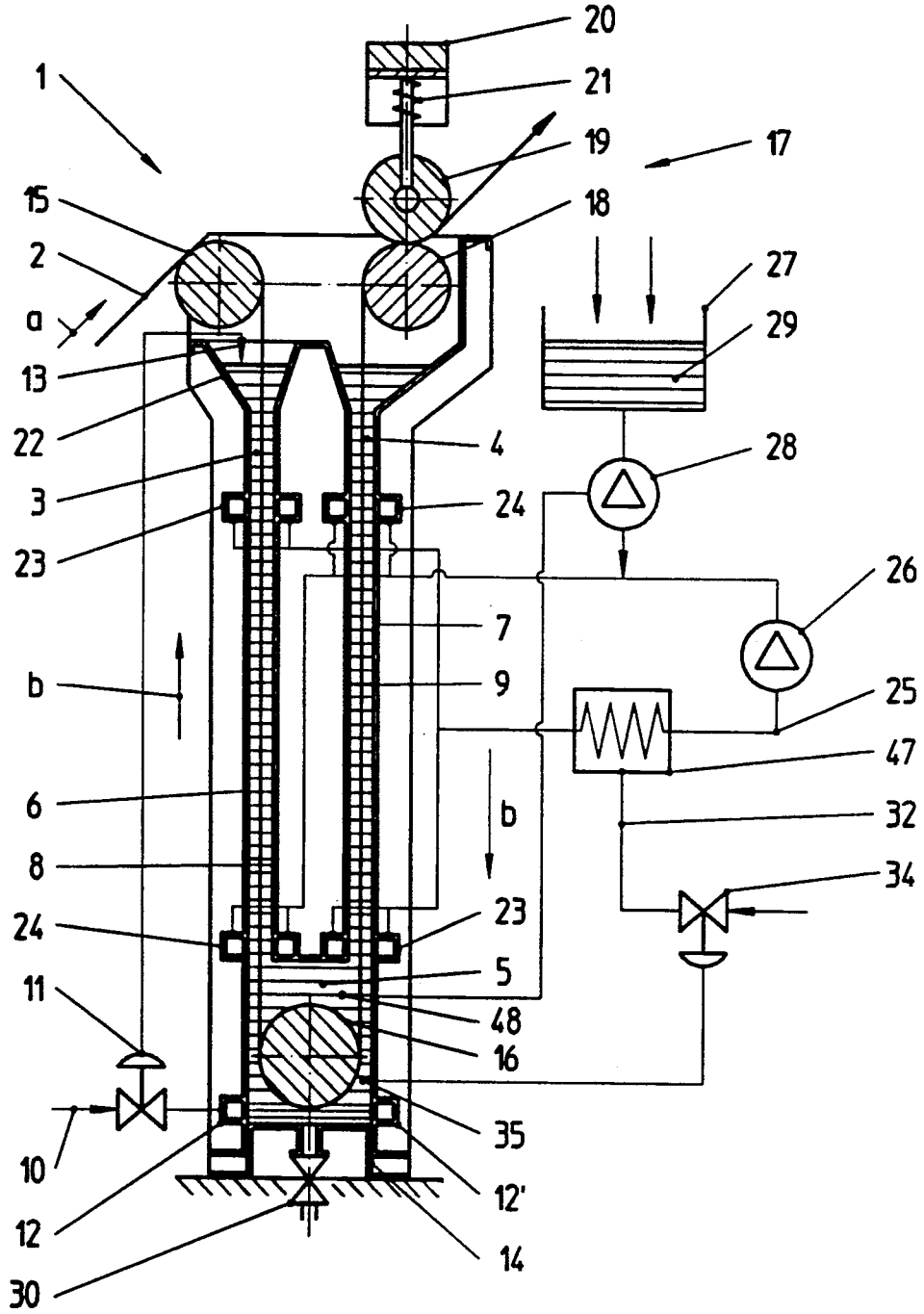

The invention concerns a method of treating a material web as well as a device for treating a material web, with a liquid. These types of methods and the associated devices are used particularly in the textile industry for the open-width treatment of woven fabric. The woven fabric is charged with a treatment liquid in the treatment zone and then passes on to a steamer where the desired process takes place. In this way, cotton, linen or mixtures with synthetic fibres can be sized, boiled, bleached or dyed.

With most of the known plant for open-width treatment, a normal washing section with standing bath is used for impregnation of the woven fabric. This evidently demands relatively large liquid volumes. First of all, attempts were made to avoid this with the use of economy troughs. The disadvantage of these economy troughs is that the loading of the woven fabric with treatment liquid is not always satisfactory on account of the relatively short submersion length.

Treatment devices, respectively methods have also already been made known with which the material web, in a stretched condition, is guided through at least one U-shaped shaft filled with treatment liquid. Examples of such plant are described in U.S. Pat. No. 3,315,501 or in FR-A-2,037,438. The supply of fresh treatment liquid ensues here, however, always above the liquor level, and this is associated with relatively heavy formation of foam. Apart from that, there is no thorough recirculation of the treatment liquid in either of the shaft limbs, neither flowing in the direction of travel of the material web or in counterlow, so that the treatment zone available is only insufficiently exploited.

It is therefore a purpose of the invention to create a method of the type mentioned in the introduction, with which uninterrupted and intensive treatment can be achieved within the smallest of spaces. This purpose, in relation to the method, is solved by the method and apparatus described below.

Guidance of the material web through a U-shaped shaft, the shaft walls of which enclose the material web relatively closely, permits extremely economic use of treatment liquid. Apart from that, liquid can be continually resupplied, which raises the intensity of the treatment. Since supply, and extraction of the treatment liquid occur beneath the surface of the liquor, the formation of foam is prevented.

Flow speed in the shaft limbs, in relation to the material web, can be adjusted to a definite value in order thus to aim at a further treatment effect. This flow speed can be changed with an adjustable delivery circulation pump.

The liquor level can be continually measured, and with lowering of the liquor level new liquid can be supplied. This replenishment occurs in the connecting area between the two shaft limbs with particular advantage. A turbulent flow is formed there, the woven fabric being loaded intensively throughout the entire depth with treatment liquid. Apart from that, the treatment liquid in the limbs of the shaft can be extracted at one end and resupplied at the other end, either in counterflow or flowing in the direction of travel of the material web. The counter flow operation causes a very intensive exchange of liquor and a turbulent flow, also in the shaft limb. On the other hand, operation flowing in the direction of travel of the material web will support the transport of the woven fabric and thus provide a particularly protective treatment in the treatment zone.

The concentration of treatment liquid can be permanently measured, either concentrate or diluent being supplied in the case of a change to the concentration. Since the difference between the degree of charge of the material web when entering and when leaving can be ascertained in advance and always remains approximately the same, an equivalent portion of concentrate or diluent, corresponding to the desired concentration, can be continuously supplied. Measuring of the concentration is in this case superfluous. In this way, together with the already mentioned level control, it will be ensured that constant operating conditions will prevail in the treatment zone.

The concentration of the treatment medium is preferably measured in the connecting area between the two shaft limbs of the U-shaped shaft. There is sufficient space available there and, as a result of the turbulent flow prevailing there, the treatment medium will be intensively mixed so that constantly representative values will be measured.

Further advantages can be achieved if the walls of the U-shaped shaft are heated, said walls being formed as hollow walls through which heating medium is fed. The supply of heating medium can, with that, be controlled via a temperature sensor within the shaft. By means of this heating device, the temperature in the treatment zone can be controlled in a particularly advantageous way.

The temperature sensor is also arranged, for the same reason as the concentration sensor, in the connecting area between the two shaft limbs.

In order to facilitate both introduction of the woven fabric into the U-shaped shaft, and the cleaning of the shaft, it is particularly advantageous if the outer shaft walls are arranged to be able to be displaced or pivoted in relation to the inner shaft walls. In this way, the shaft limb can be opened out, with merely a relatively small volume of liquid having to be previously drained off.

Figure 2:
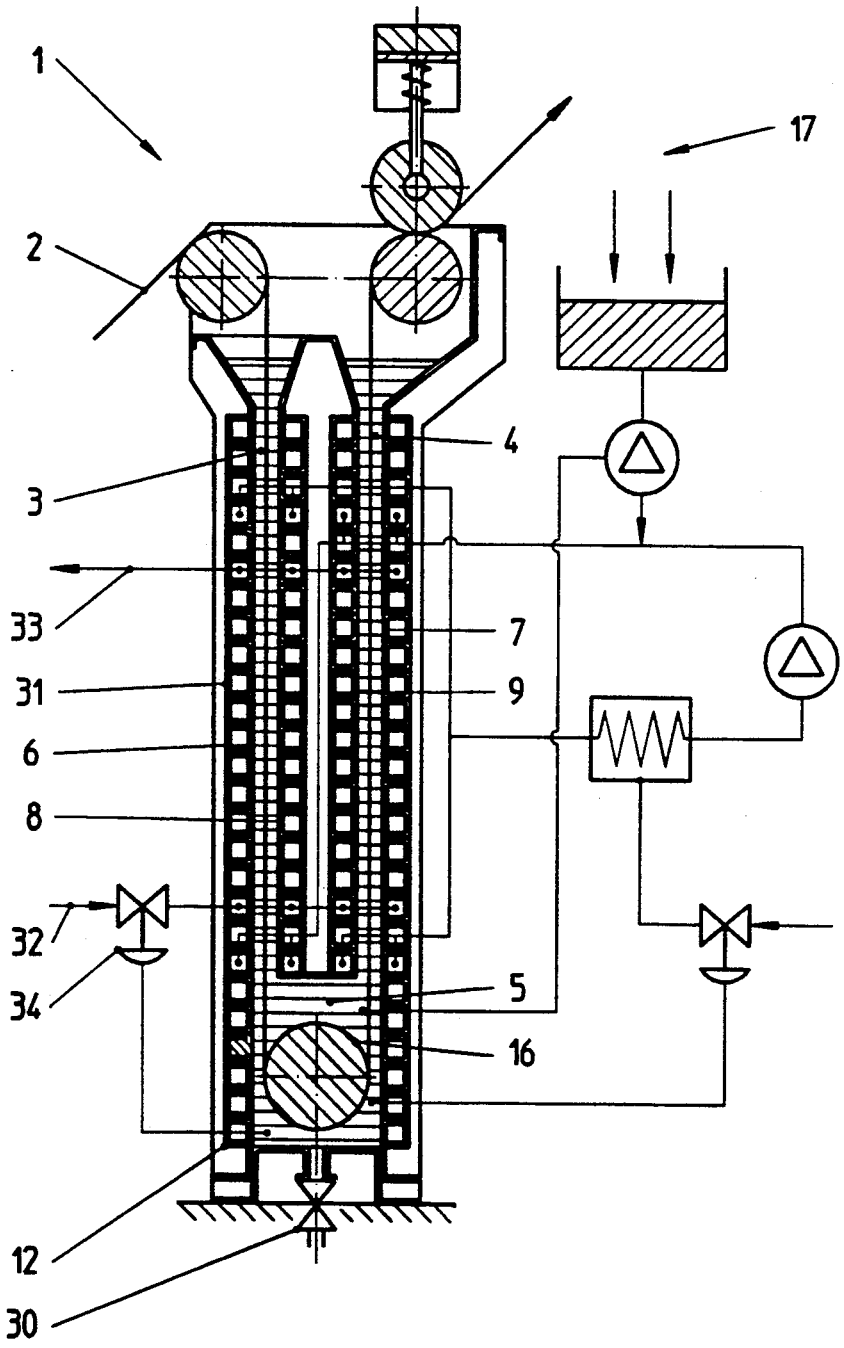
Figure 3:
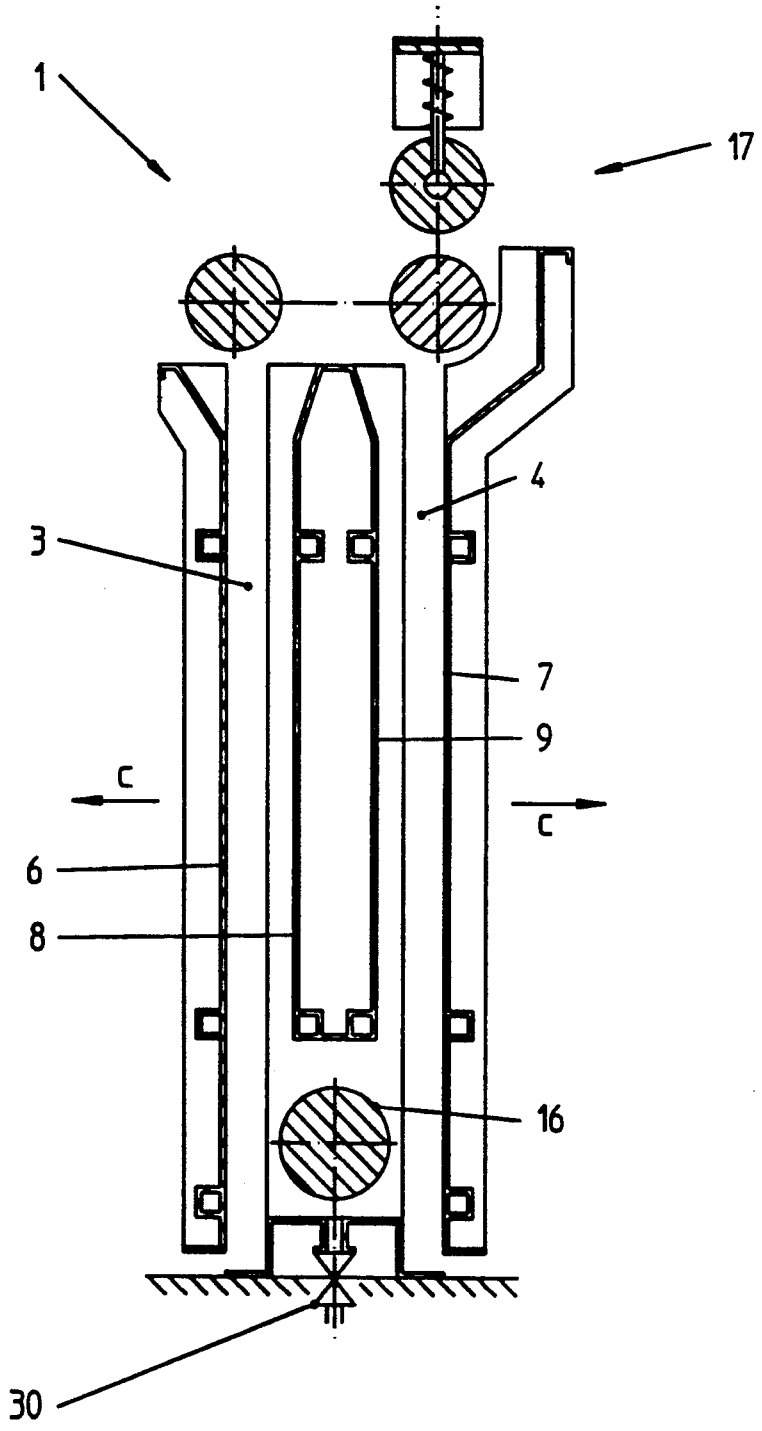
Figure 4:
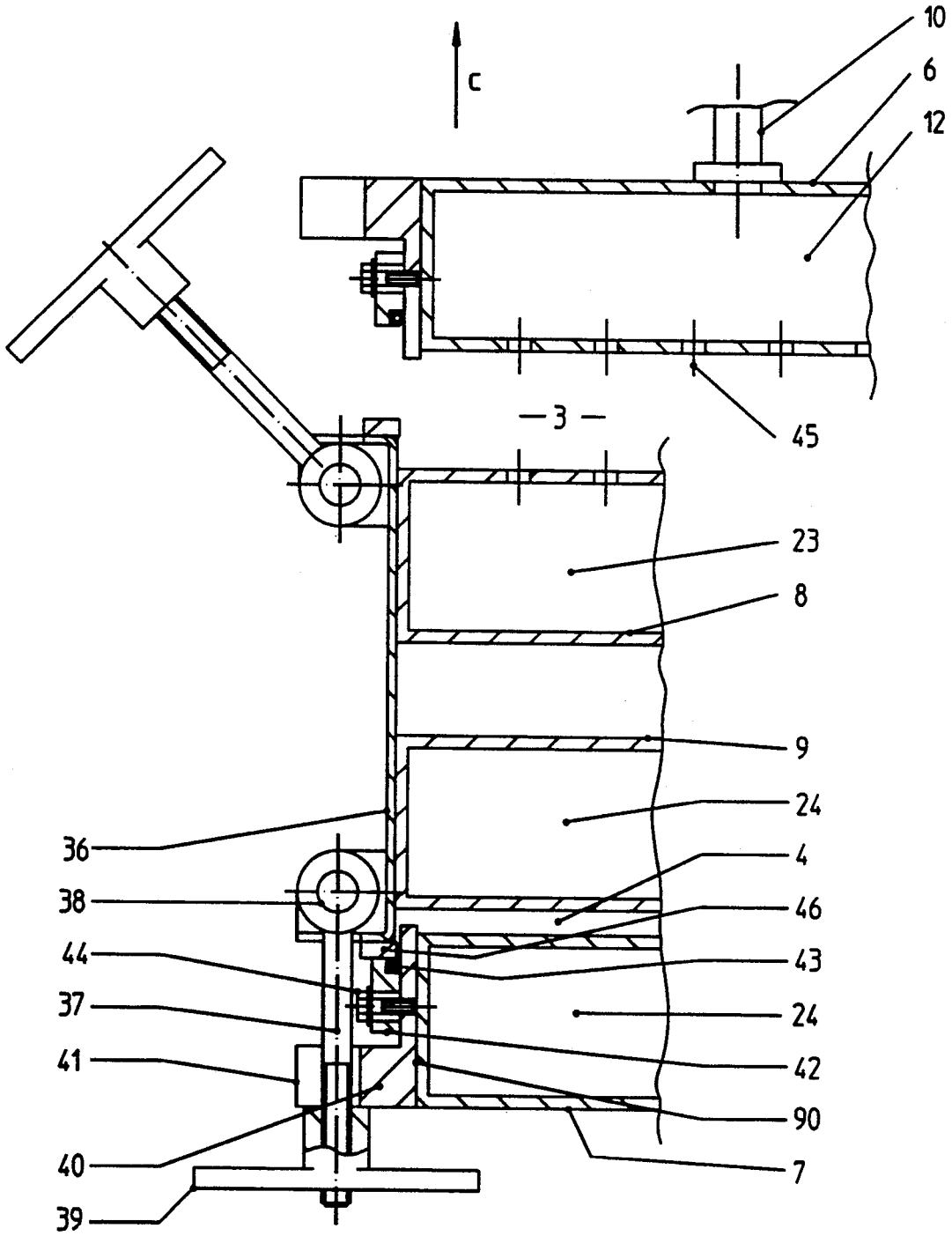

Further individual features and advantages of the invention arise from the following description and from the drawings. Namely:

FIG. 1 a highly simplified cross section through a device according to the invention, FIG. 2 an alternative embodiment of a device with heatable shaft walls, FIG. 3 the device according to FIG. 1 with outer walls in the extended position, and FIG. 4 a partial cross section through the device according to FIG. 2, in somewhat enlarged scale.

FIG. 1 shows an impregnating compartment 1 which possesses a U-shaped shaft. The shaft is formed, in its entirety, by the lefthand shaft limb 3, the righthand shaft limb 4 and by the common connecting area 5, which connects both the shaft limbs together. The upper ends of both the shaft limbs 3 and 4 are provided with a conical extension 22. The shaft stands on a support frame 14 and has a width that is somewhat larger than the width of the material web 2 to be treated.

The material web 2 is introduced into the lefthand shaft limb 3 in the direction of the arrow A via a guide roller 15, is deflected around a deflection roller 16 in the connecting zone and once again guided upwards in the righthand shaft limb 4. The material web is, constantly stretched and does not make contact with the shaft walls. As will be more closely described in the following, the inner shaft walls 8 and 9 are arranged to be fixed on the support frame 14, whilst the outer shaft walls 6 and 7 can be displaced or pivoted outwards.

A charge mangle 17, with which the degree of charge of the material web can be determined through a greater or lesser degree of squeezing, is arranged immediately next to the upper end of the righthand shaft limb 4. The charge mangle comprises a fixed lower roller 18 and a press roller 19. The press roller can be pressed against the fixed lower roller 18 with the aid of a pressure cylinder 20. Here, a pressure spring 21 causes complete release of the press roller 19 when no inner pressure exists in the pressure cylinder 20. This arrangement enables the press roller to be only gently placed against the material web, so that instead of squeezing, only a wipe of the treatment liquid will ensue. The squeezed or wiped treatment liquid flows back into the righthand shaft limb.

The level of treatment liquid is continuously measured by means of a level measuring device 13 at the upper end of one shaft limb. A control valve 11 in a feed pipe 10 for new treatment liquid can be activated by means of the level measuring device. Treatment liquid with the same properties can be supplied via this pipe when the liquor level sinks. Also, for example, only a diluent such as water can be supplied, whilst the correct concentration of treatment liquid can be maintained in other ways. The feed pipe 10 opens out into the injection pipes 12 and 12', which are arranged on both sides of the connecting area 5, and which preferably extend over the entire width of the shaft. The treatment liquid can be injected under pressure from these pipes.

In order to influence the flow relationships in both the shaft limbs 3 and 4, the upper and the lower ends of these shafts are connected to a pipe network 25. The connections are diagonally opposed, so that the upper end of the lefthand shaft 3 and the lower end of the righthand shaft limb 4 and the lower end of the lefthand shaft limb 3 and the upper end of the righthand shaft limb 4 are in each case combined. A circulation pump 26 is integrated into the pipe network 25, so that the treatment liquid is set into a circulating motion. For the particularly advantageous counterflow operation, treatment liquid is extracted from the withdrawal pipes, 23 and forced into the feed pipes 24, so that a counterflow ensues in the direction of the arrow B. The circulating pump 26 is however reversible, so that it can also pump in the direction of travel of the woven fabric 2. The pipes 23 and 24 open out into the shaft in pairs, approximately opposite each other.

In order to ensure temperature control, also with this embodiment, a heating element 47 is integrated into the pipe network 25 which, via the pipe 32, can be heated with a heating medium. A temperature sensor 35 measures the temperature in the shaft and controls the control valve 34. In this way, the treatment liquid can either be heated or cooled.

In order to maintain a set concentration of the treatment liquid, the shaft is connected to a storage container 27 which contains treatment liquid at a heightened concentration. With the embodiment in question, the connection ensues via the pipe network 25. The concentrate 29 can be fed into the pipe network via a feed pump 28. A concentration measuring device, not shown here in any greater detail, arranged in the connecting area common to the two shafts, has a concentrate measuring sensor 48. When the concentration sinks, the feed pump 28 can be activated by means of the concentrate measuring device. The concentrate measuring device can, however, when an increased concentration is detected, also activate the control valve 11, which releases diluent being fed through the feed pipe 10.

Alternatively, the feed pump 28 and the control valve 11 can also continuously supply a predetermined mixture of concentrate and water, corresponding to the volume of treatment liquid drawn-off by the web on departure from the charge mangle 17.

In the embodiment of FIG. 1, the shaft walls 6 to 9 are formed merely by simple plates which, when necessary, are additionally provided with stiffening elements. In order to be able to empty the shafts when opening the outer walls 6 and 7, a drain valve 30 is arranged in the bottom.

An alternative embodiment is shown in FIG. 2, wherein the shaft walls 6 to 9 are formed as hollow walls through which a heating medium such as steam can be fed. All other functions, in particular the circulation of liquid within the shaft limbs, the supply of fresh treatment medium and the control of the concentration are exactly the same as in the preceding example. The shaft walls preferably comprise tubular profiles 31 which are welded together, rectangular tubes having particularly proved themselves. In this way also particularly high stability of the shaft walls is achieved. The tubular profiles are connected together by bores in their adjacent areas, this is indeed preferable so that a meandering flow will take place.

Steam is fed to the apparatus of FIG. 2 via a supply pipe 32 opening out into hollow walls in the lower area of the two shaft limbs 3 and 4. The moveable outer walls 6 and 7 are, with that, connected to the fixed inner walls 8 and 9 via flexible tubing, since the outer walls are able to be displaced. The steam flows upwards into the hollow walls and is once again extracted at a drain pipe 33. In the upper area, too, the flexible and the fixed shaft walls are connected together by means of flexible tubing. In order to achieve temperature regulation, a temperature sensor 35 is arranged in the shaft, said sensor activating a control valve 34 in the feed pipe 32.

FIG. 3 shows the device according to FIG. 1 in an opened condition, i.e. with the outer walls 6 and 7 extended in the direction of the arrow C in a parallel plane to the fixed inner walls 8 and 9, a widening of the shaft limbs 3 and 4 being aimed at. This evidently facilitates introduction of the material web as well as cleaning of the shaft, the shaft being drained in advance via the drain valve 30. The displacement or pivoting of the outer walls can be achieved by various means such as rails, a lever mechanism etc.

FIG. 4 shows a partial cross section through a device according to the invention, the construction of the side walls being able to be observed in more detail. Both the inner shaft walls 8 and 9 are fixed firmly to the side pillars 36. Tensioning rods 37 mounted on studs 38, are linked to these pillars at definite intervals over their entire height. At their sides, the moveable outer shaft walls 6 and 7 have companion parts 40 with corresponding slots 41. The tensioning rods 37 have a thread onto which a lever or hand wheel 39 is screwed. Thus the companion part 40 can be, in the closed condition, tensioned against the pillar 36. The actual sealing of the shaft limb ensues at a counterpart 46, against which a seal 43 is pressed. This seal sits in a sealing part 42 which is held against the companion part 40, to be able to displace, by means of a tensioning bolt 44. In this way also the width of the shaft limb can be adjusted.

The outer wall 6 is shown in an extended condition in the upper half of the illustration. The hand wheel 39 on the tensioning rod 37 is released and the tensioning rod 37 is pivoted sideways out of the slot 41. Now the outer wall 6 can be extended outwards, guided by a suitable means. The tensioning rods 37 are exclusively for applying the sealing force pressure.

In FIG. 4, the section is drawn in the region of the outer wall 6 through an injection pipe 12. With that, the openings 45 are able to be seen, from which the treatment medium, pumped in via the feed pipe 10, can be sprayed into the shaft limb 3.

Inasmuch as the invention is subject to modifications and variations, the foregoing description and accompanying drawings should not be regarded as limiting the invention, which is defined by the following claims and various combinations thereof:

I claim:

1. A method of treating a web of material with a treatment liquid, said method comprising steps of guiding the material web in a stretched condition in a predetermined direction through at least one U-shaped shaft, containing said treatment liquid, said shaft having two limbs joined at a common connecting area, supplying fresh treatment liquid beneath the liquid's surface level, and, in each limb of the shaft, drawing off liquid at one end of the limb, while feeding liquid into the other end of the limb, selectively in counterflow to or in the direction of travel of the material web.

2. The method of claim 1, wherein the treatment liquid is fed into and drawn off from the limbs of the shaft on both sides of the material web.

3. The method of claim 1, further comprising steps of measuring the surface level of the liquid and, when said level falls below a set level, introducing fresh treatment liquid into the connecting area between the limbs of the shaft.

4. The method of claim 1, further comprising steps of measuring concentration of the treatment liquid and, upon detecting a change of concentration, adding either concentrate or a diluent to said liquid to correct the concentration.

5. The method of claim 4, wherein the concentration of the treatment liquid is measured in the common connecting area.

6. The method of claim 1, further comprising a step of continuously adding treatment liquid to the shaft at a rate just sufficient to compensate for liquid being removed from the shaft by the material passing through it.

7. The method of claim 1, further comprising a step of heating the walls of the shaft.

* * * * *